US008181836B2

(12) United States Patent
Shkolnikov et al.

(10) Patent No.: US 8,181,836 B2
(45) Date of Patent: May 22, 2012

(54) ROTARY FASTENER MAGAZINE

(75) Inventors: Yury Shkolnikov, Glenview, IL (US); Anatoly Gosis, Palatine, IL (US); Anthony Caringella, Norridge, IL (US); Asim B. Siddiqui, Elgin, IL (US); Kyle Thomas Kestner, Schaumburg, IL (US)

(73) Assignee: Illinois Tool Works Inc., Glenview, IL (US)

( * ) Notice: Subject to any disclaimer, the term of this patent is extended or adjusted under 35 U.S.C. 154(b) by 330 days.

(21) Appl. No.: 12/543,972

(22) Filed: Aug. 19, 2009

(65) Prior Publication Data

US 2010/0051666 A1 Mar. 4, 2010

Related U.S. Application Data

(60) Provisional application No. 61/093,811, filed on Sep. 3, 2008.

(51) Int. Cl.
*B25C 1/04* (2006.01)

(52) U.S. Cl. ..... 227/120; 227/8; 227/109; 227/136

(58) Field of Classification Search ..... 227/120, 227/8, 136, 135, 119, 156, 109, 127
See application file for complete search history.

(56) References Cited

U.S. PATENT DOCUMENTS

| | | | | | |
|---|---|---|---|---|---|
| 1,344,715 | A | * | 6/1920 | Pope | 227/137 |
| 2,368,552 | A | * | 1/1945 | La Place | 227/120 |
| 3,266,697 | A | | 8/1966 | Fiedler | |
| 3,305,156 | A | * | 2/1967 | Khan | 227/132 |
| 3,437,249 | A | | 4/1969 | Baum | |
| 3,504,840 | A | | 4/1970 | Wandel et al. | |
| 3,742,577 | A | | 7/1973 | Buttriss | |
| 3,980,179 | A | * | 9/1976 | Schrepferman | 206/338 |
| 4,091,981 | A | | 5/1978 | Moriguchi et al. | |
| 4,483,473 | A | | 11/1984 | Wagdy | |
| 4,522,162 | A | | 6/1985 | Nikolich | |
| 4,552,297 | A | * | 11/1985 | Belanger et al. | 227/120 |
| 4,558,811 | A | * | 12/1985 | Klaus | 227/116 |
| 4,784,306 | A | | 11/1988 | Baum | |
| 5,038,993 | A | | 8/1991 | Schafer et al. | |
| 5,288,004 | A | | 2/1994 | Johnsson et al. | |
| 5,497,931 | A | * | 3/1996 | Nakamura | 227/109 |
| 5,626,274 | A | | 5/1997 | Shkolnikov et al. | |
| 6,145,724 | A | | 11/2000 | Shkolnikov et al. | |
| 6,179,194 | B1 | * | 1/2001 | Morton | 227/133 |
| 6,299,046 | B1 | * | 10/2001 | Chen | 227/109 |
| 6,598,777 | B2 | * | 7/2003 | Osuga et al. | 227/136 |
| 6,641,019 | B2 | * | 11/2003 | Hadfield | 227/109 |
| 6,679,414 | B2 | | 1/2004 | Rotharmel | |
| 6,837,414 | B1 | * | 1/2005 | Chou | 227/109 |
| 6,863,204 | B2 | * | 3/2005 | Lu | 227/109 |
| 7,143,920 | B2 | | 12/2006 | Panasik et al. | |
| 7,328,826 | B2 | | 2/2008 | Shkolnikov | |
| 2003/0034377 | A1 | | 2/2003 | Porth et al. | |

* cited by examiner

*Primary Examiner* — Scott A. Smith
(74) *Attorney, Agent, or Firm* — Greer, Burns & Crain, Ltd.; Patty Chidiac; Mark W. Croll

(57) ABSTRACT

A fastener driving tool is provided, including a housing substantially enclosing a power source including a reciprocating piston with a driver blade. A nosepiece is associated with the housing and is configured for receiving the driver blade and for sequentially receiving fasteners for engagement with the driver blade for driving into a workpiece. A magazine is configured for retaining a supply of the fasteners and for sequentially feeding the fasteners to the nosepiece, the magazine storing a plurality of elongate strips of the fasteners, and being configured for rotating about a longitudinal axis of the magazine for providing access of fasteners in each fastener strip to the nosepiece.

17 Claims, 19 Drawing Sheets

ROTARY FASTENER MAGAZINE

RELATED APPLICATION

This application claims priority under 35 USC §119(e) from U.S. Provisional Ser. No. 61/093,811 filed Sep. 3, 2008.

BACKGROUND OF THE INVENTION

The present invention relates generally to fastener driving tools such as combustion powered tools, also known as combustion nailers, pneumatic tools, cordless framing tools and the like. More particularly, the present invention relates to improvements in fastener magazines used with such tools.

Such tools typically have a housing substantially enclosing a power source, such as combustion, pneumatic, electric or powder, a trigger mechanism and a magazine storing a supply of fasteners for sequential driving. The power source includes a reciprocating driver blade which separates a forwardmost fastener from the magazine and drives it through a nosepiece into the workpiece. The nosepiece is also the conventional attachment point for the magazine and defines the entryway for fasteners from the magazine into a fastener passage where impact with the driver blade occurs as well as subsequent transport into the workpiece. Exemplary tools are described in U.S. Pat. Nos. 4,483,473; 4,522,162; 6,145,724; and 6,679,414, all of which are incorporated by reference.

Conventional fastener driving tools are provided with fastener magazines having a box or strip configuration in which the fasteners are linearly arranged and fed to a nosepiece from which they are driven into the workpiece. A spring-loaded or otherwise biased follower urges the fasteners toward the nosepiece. Reloading occurs at the rear of the tool opposite the nosepiece. Other fastener driving tools are provided with coil magazines in which bands or strips of fasteners are arranged in a coil rather than in a linear arrangement. Examples of such magazines are disclosed in US Patent Application Publication No. 2003/0034377 and U.S. Pat. No. 7,143,920.

There has been an interest in the art of providing higher capacity fastener tool magazines. Typically, such magazines, also referred to as box magazines, have been constructed so that the fasteners are arranged side-by-side to increase fastener capacity. Examples of such magazines are disclosed in U.S. Pat. Nos. 5,626,274; 3,266,697; 3,437,249; 3,504,840; 4,784,306 and 5,038,993.

Conventional large capacity box magazines are relatively compact, and when long nails are employed, are relatively efficient in their use of space, since the magazine is dimensioned to accommodate the length of the fastener. However, when short nails are preferred and are used, as is typical, in the same, relatively tall magazine, the result is an inefficient use of magazine space, as well as tool space.

SUMMARY OF THE INVENTION

The above-listed drawback of the prior art is met or exceeded by the present rotary magazine for use on a fastener driving tool, such as a combustion nailer or the like. A cylindrical magazine is provided with a plurality of radially arranged, axially extending slots each configured for accommodating a strip of linearly arranged fasteners. Thus, the present magazine provides increased fastener capacity without requiring increased space. The tool is configured for rotating the magazine during use to allow sequential access to each slot. Due to the relatively short height of the fasteners employed, the capacity of the present magazine is significantly increased compared to conventional magazines, without requiring modification to the overall tool space requirements. Once empty, the present magazine is easily removed from the tool for replacement or reloading. In a preferred embodiment, the tool is provided with a latch that secures the rotary magazine in place against axial movement during operation, and also prevents the escape of fasteners from the magazine during the removal and/or replacement of the magazine.

More specifically, a fastener driving tool is provided, including a housing substantially enclosing a power source including a reciprocating piston with a driver blade. A nosepiece is associated with the housing and is configured for receiving the driver blade and for sequentially receiving fasteners for engagement with the driver blade for driving into a workpiece. A magazine is configured for retaining a supply of the fasteners and for sequentially feeding the fasteners to the nosepiece, the magazine storing a plurality of elongate strips of the fasteners, and being configured for rotating about a longitudinal axis of the magazine for providing access of fasteners in each fastener strip to the nosepiece.

In another embodiment, a magazine for a fastener driving tool is provided, including a generally cylindrical magazine housing having a plurality of peripherally spaced, radial slots extending along a longitudinal axis of the housing, each slot configured for accommodating a plurality of linearly arranged fasteners. An axial bore is provided upon which the housing is rotatable for providing selected sequential access to the slots.

DESCRIPTION OF THE PREFERRED EMBODIMENT

Figure 1:
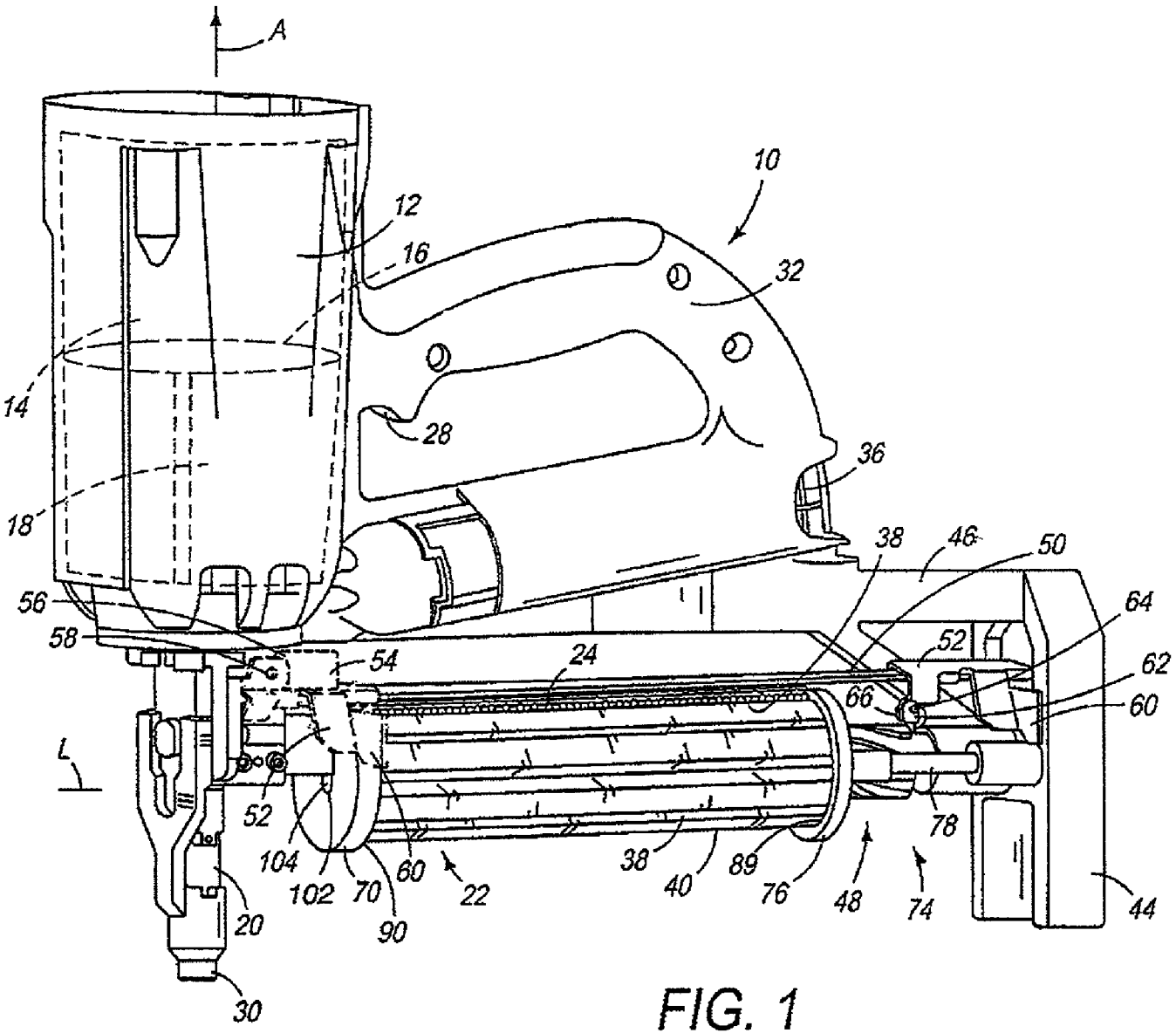
FIG. 1 is a side perspective view of a fastener driving tool equipped with the present rotary magazine.
Figure 2:
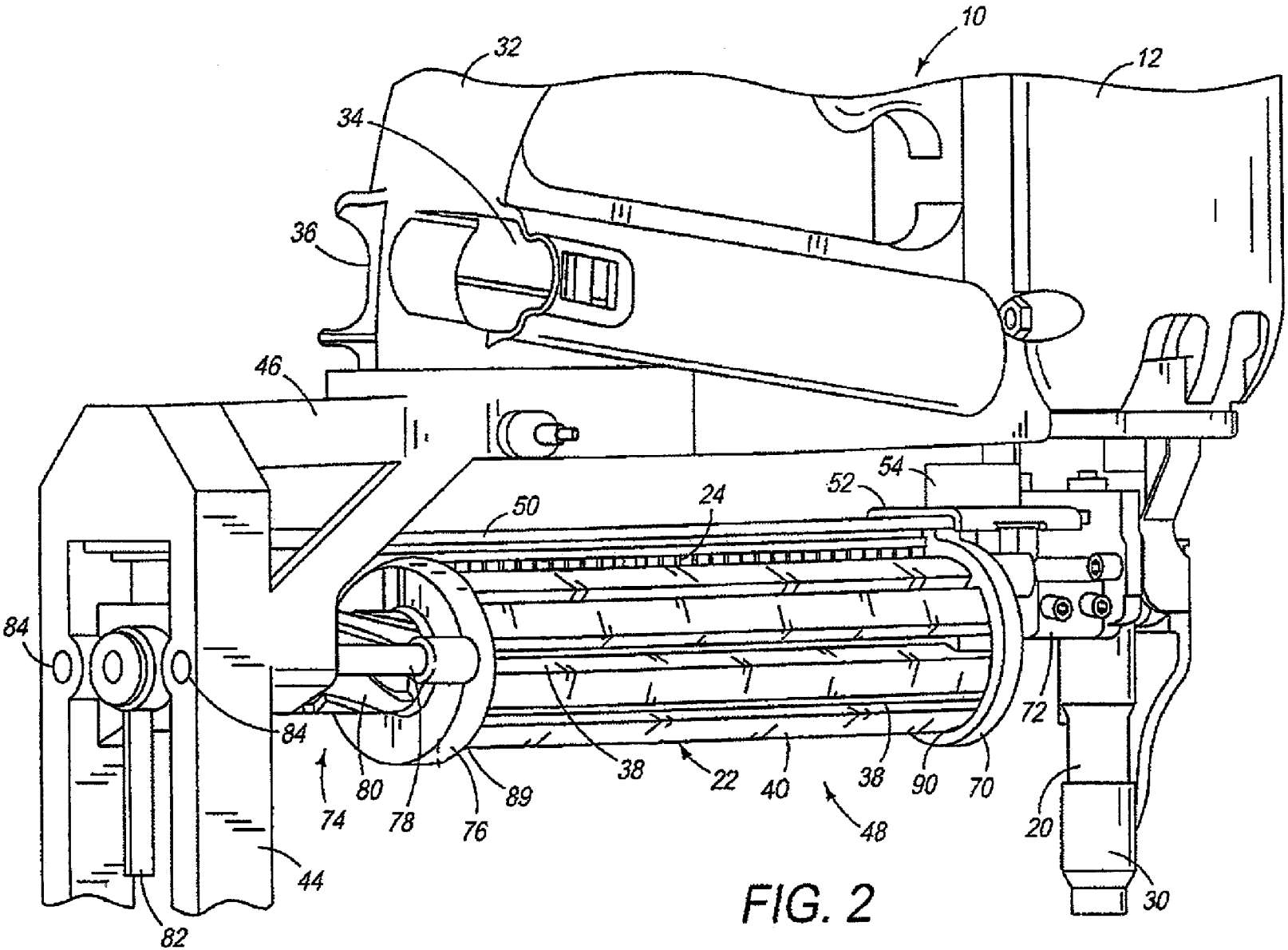
FIG. 2 is an opposite side perspective view of the tool of FIG. 1.

Referring now to FIGS. 1 and 2, a fastener driving tool suitable for use with the present improved depth of drive apparatus is generally designated 10, and while shown as a combustion powered tool or combustion nailer, it is understood that the present magazine may be used with other fastener driving tools, including but not limited to pneumatic, electric and powder-activated tools. The tool 10 includes a housing 12 which defines an axis "A" and at least substantially encloses a power source 14 (shown hidden) including a reciprocating piston 16 having a driver blade 18 (shown hidden) secured thereto for common movement relative to the power source.

Figure 9:
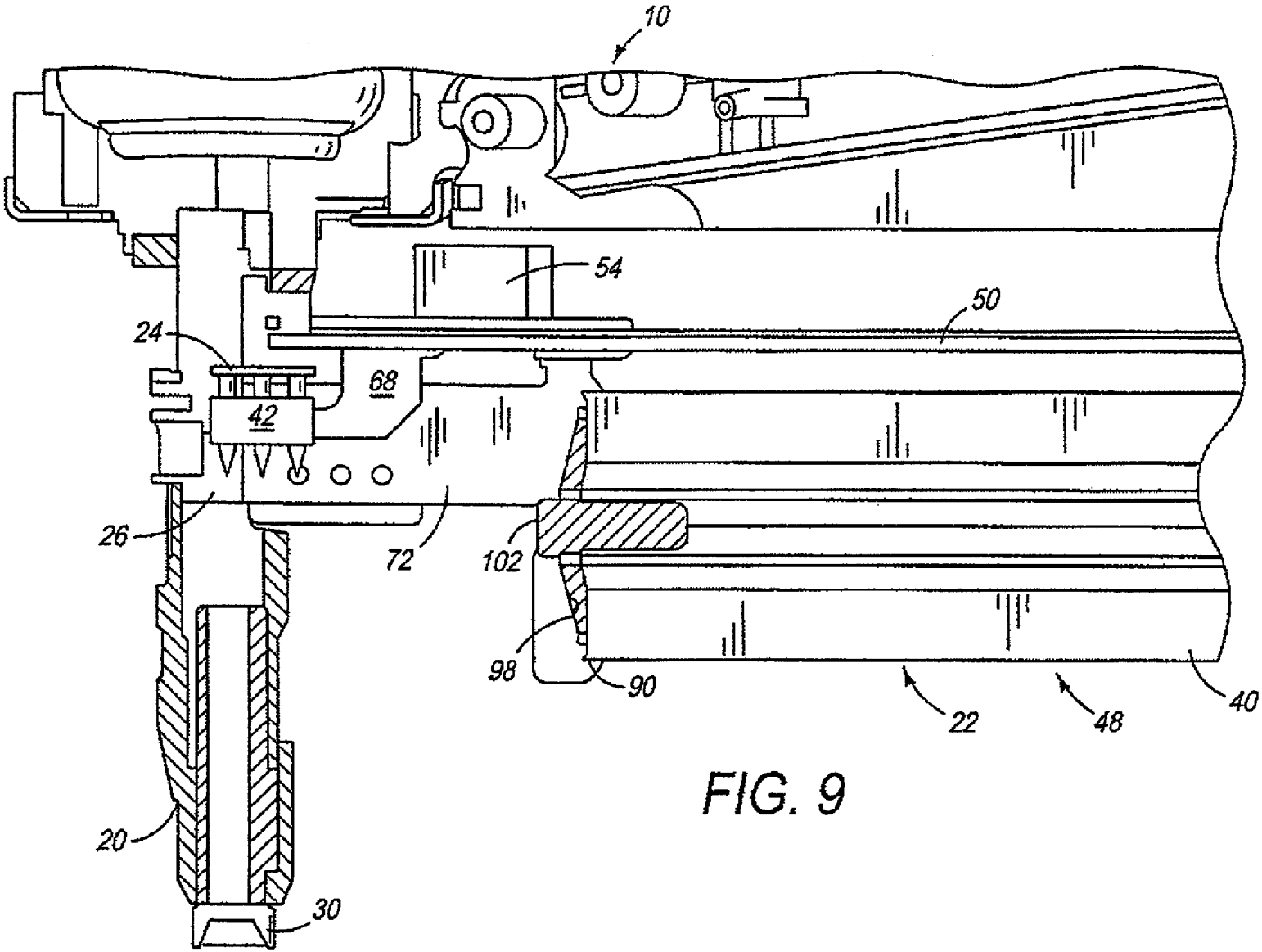
FIG. 9 is a fragmentary side elevation of the tool of FIG. 1 with portions shown in vertical section.

A nosepiece 20 is secured to a lower end of the power source 14 as is known in the art and provides an attachment point for a fastener magazine 22. Fasteners 24 (FIG. 3) are fed sequentially into the nosepiece 20 where they are engaged by the driver blade 18 traveling down a fastener passageway 26 (FIG. 9). The fasteners 24 are driven into a workpiece or substrate after initiation of a power cycle, initiated in some tools by the operator actuating a trigger 28. A workpiece contact element 30 reciprocates relative to the nosepiece 20 to control tool functions as is known in the art, but is not relevant to the present discussion.

Also provided to the housing 12 is a handle 32 which serves as the mounting point for the trigger 28. A battery chamber 34 (FIG. 2) is also provided to the housing 12 for accommodating at least one battery (not shown) for powering electronic tool functions such as spark generation, cooling fan operation, electronic fuel injection and/or tool condition sensing as known in the art. On an opposite side of the housing 12 from the battery chamber 34 is a fuel cell chamber 36 for accommodating a fuel cell (not shown) as is known in the art for powering combustion in the power source 14. It will be understood that fuel cell storage is variable depending on the requirements and/or configuration of the particular tool or housing.

Figure 3:
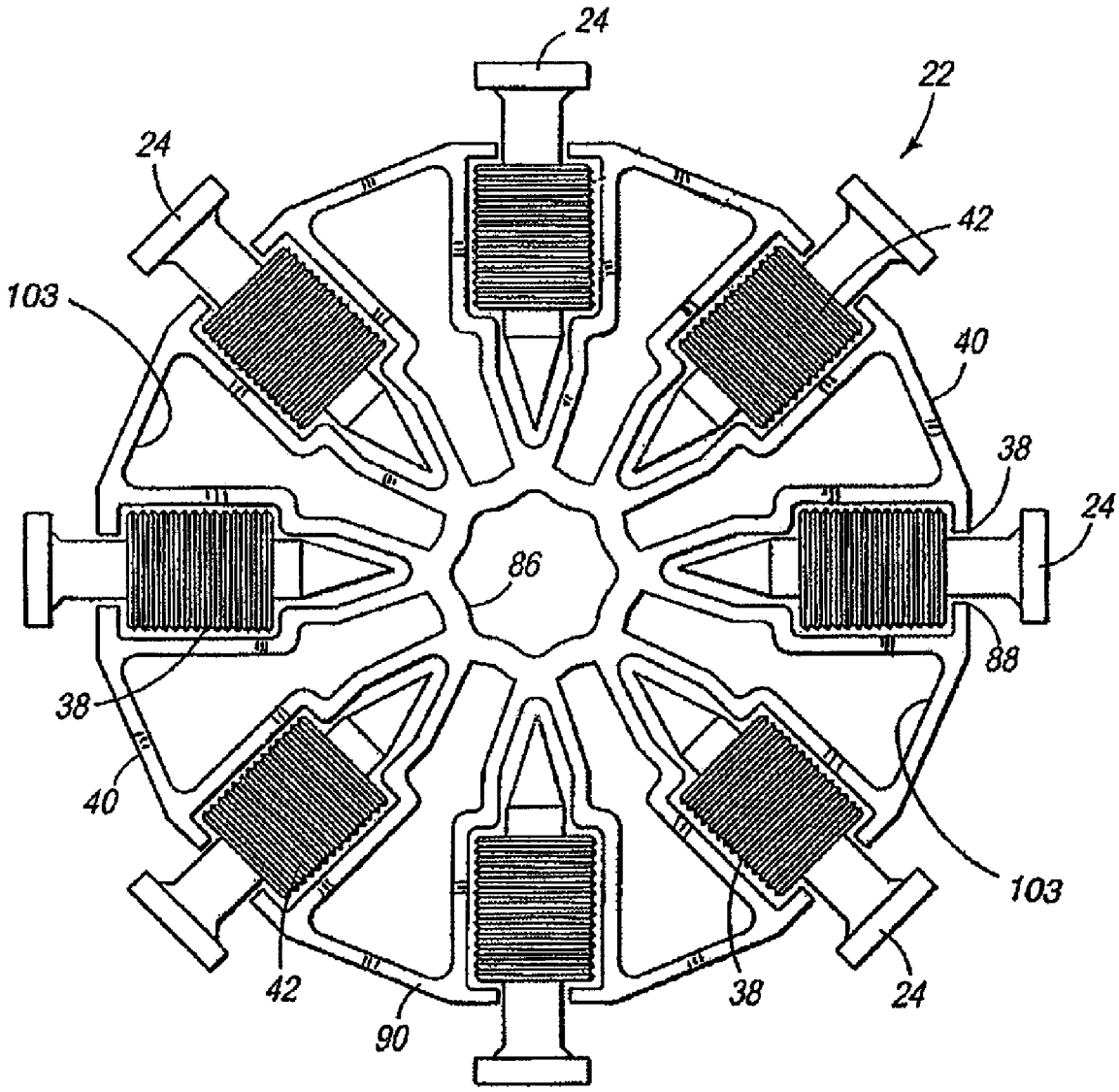
FIG. 3 is an end elevation view of the present magazine.
Figure 4:
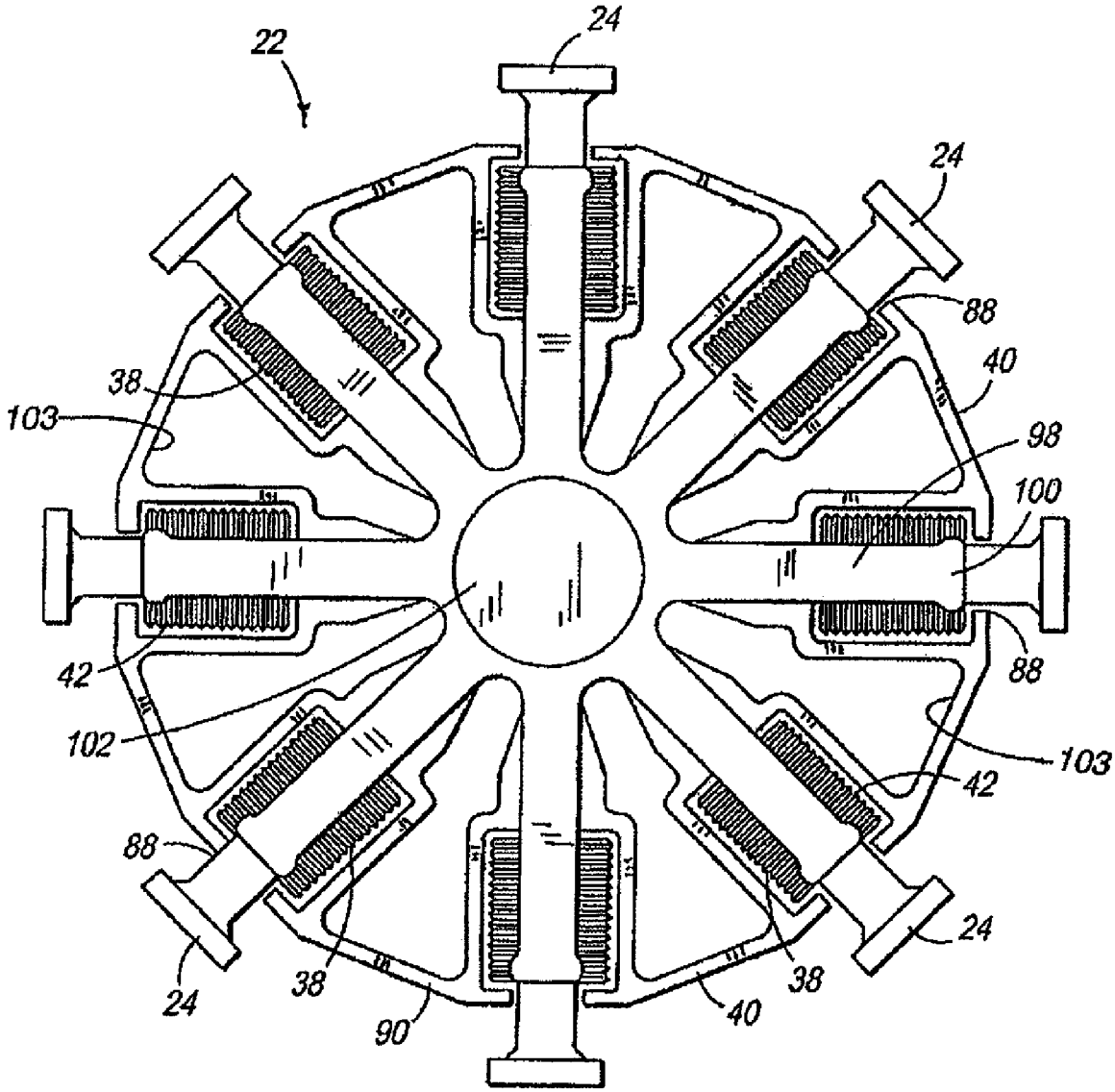
FIG. 4 is an end elevation view of the magazine of FIG. 3 shown with a fastener keeper in a storage position.
Figure 5:
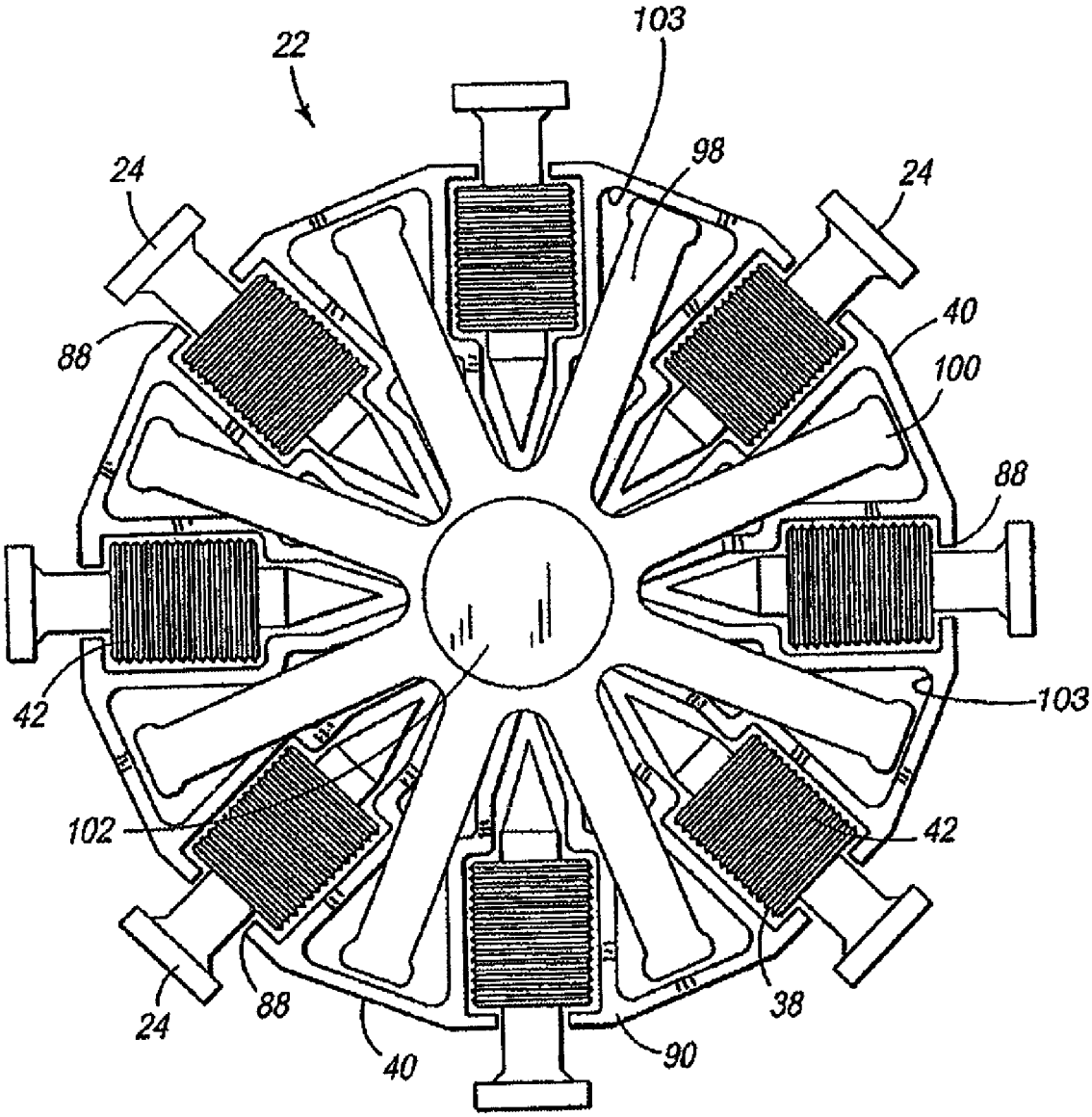
FIG. 5 is an end view of the present magazine as shown in FIG. 4 showing the fastener keeper adjusted to a use position.
Figure 6:
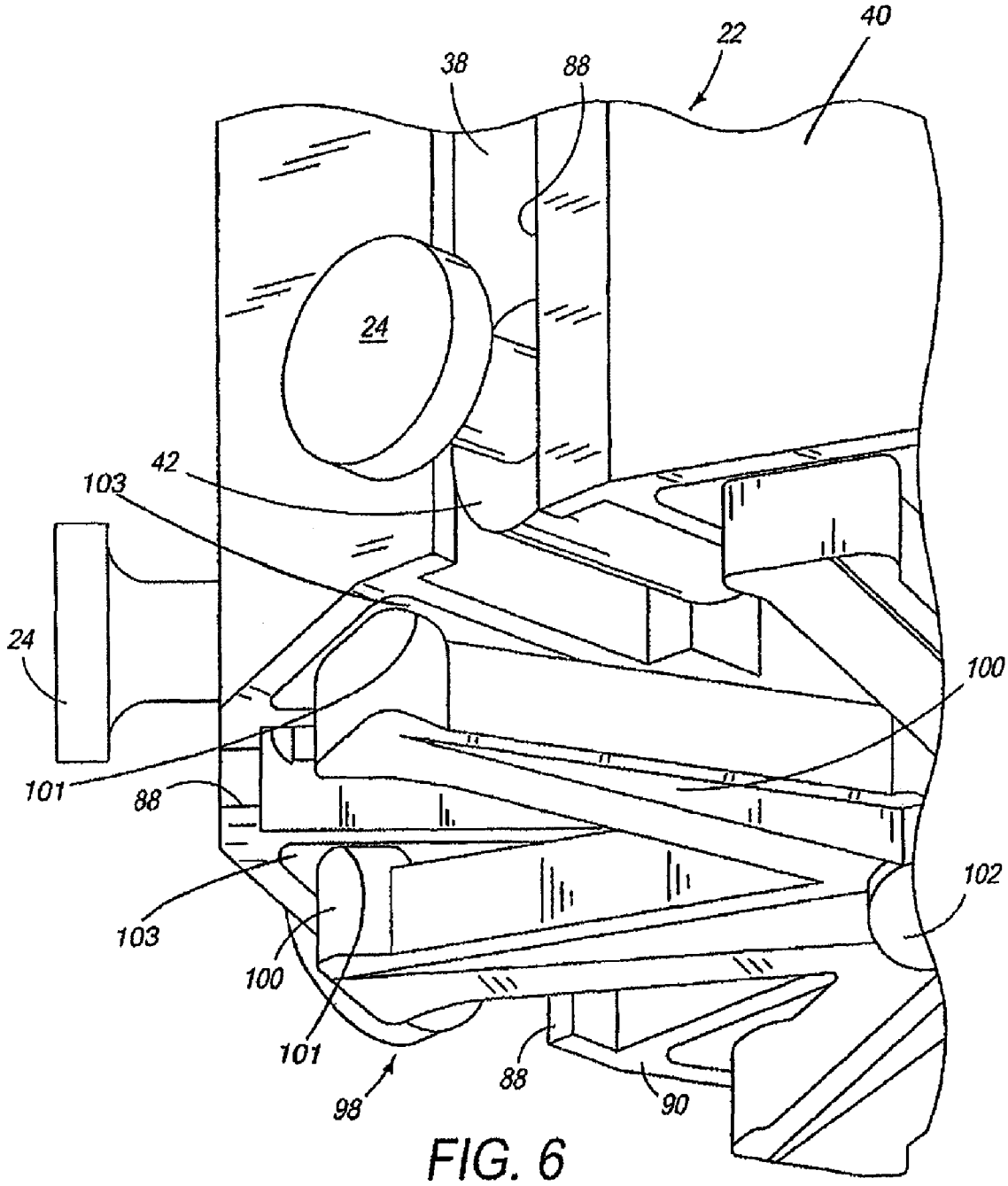
FIG. 6 is a fragmentary perspective view of the present magazine in the position depicted in FIG. 5.

Referring now to FIGS. 1-3, a feature of the present magazine 22 is that it is configured for storing a supply of the fasteners 24, preferably in strips, with each strip located in an elongate fastener slot 38 in a magazine housing 40. The magazine 22 is rotatable about a longitudinal axis "L" so that fasteners 24 in multiple fastener slots 38 are sequentially fed to the nosepiece 20. In the present application, "strip" will be understood to refer to a longitudinal or linear array of fasteners 24, whether or not adjacent fasteners are secured to each other, as through collating material 42. As is known in the art, collating material 42 includes paper or plastic materials, optionally provided with adhesive for securing adjacent fasteners together.

As seen in FIG. 1, the magazine 22 is secured between the nosepiece 20 and a rear bracket 44 of a support frame 46 which is secured to the housing 12. The support frame 46 supports a first or rear end of the magazine 22, and the nosepiece 20 supports a second or front end of the magazine. The nosepiece 20 and the rear bracket 44 combine to define a magazine area 48 which is comparable in size to the dimensions required for a conventional strip magazine known in the art. A feature of the present magazine 22 is that is has a significantly greater capacity of the fasteners 24 than conventional single strip magazines, while taking up no more space in the overall profile of the tool 10. It will be appreciated that the preferred fasteners used with the present magazine 22 are relatively short, in the range of less than 2 inches (5 cm).

A follower rail 50 is secured and extends between the nosepiece 20 and the rear bracket 44, and supports a magazine follower 52 which is biased toward the nosepiece 20 by a return or negator spring 54. In FIG. 1, the follower 52 is depicted in two positions, a fully extended position (shown in broken lines) where it is close to the nosepiece 20, and a fully retracted position where it is closest to the rear bracket 44 and is lockable for fastener loading. It will be understood that when the follower 52 is extended, or closest to the nosepiece 20, the spring 54 is retracted, and when the follower is fully retracted, the spring is fully extended. An end 56 of the spring 54 is secured to the nosepiece 20 at an associated eyelet 58 by a fastener (not shown). Included on the follower 52 is a handle 60 which is manipulated by the tool user or operator.

Figure 11:
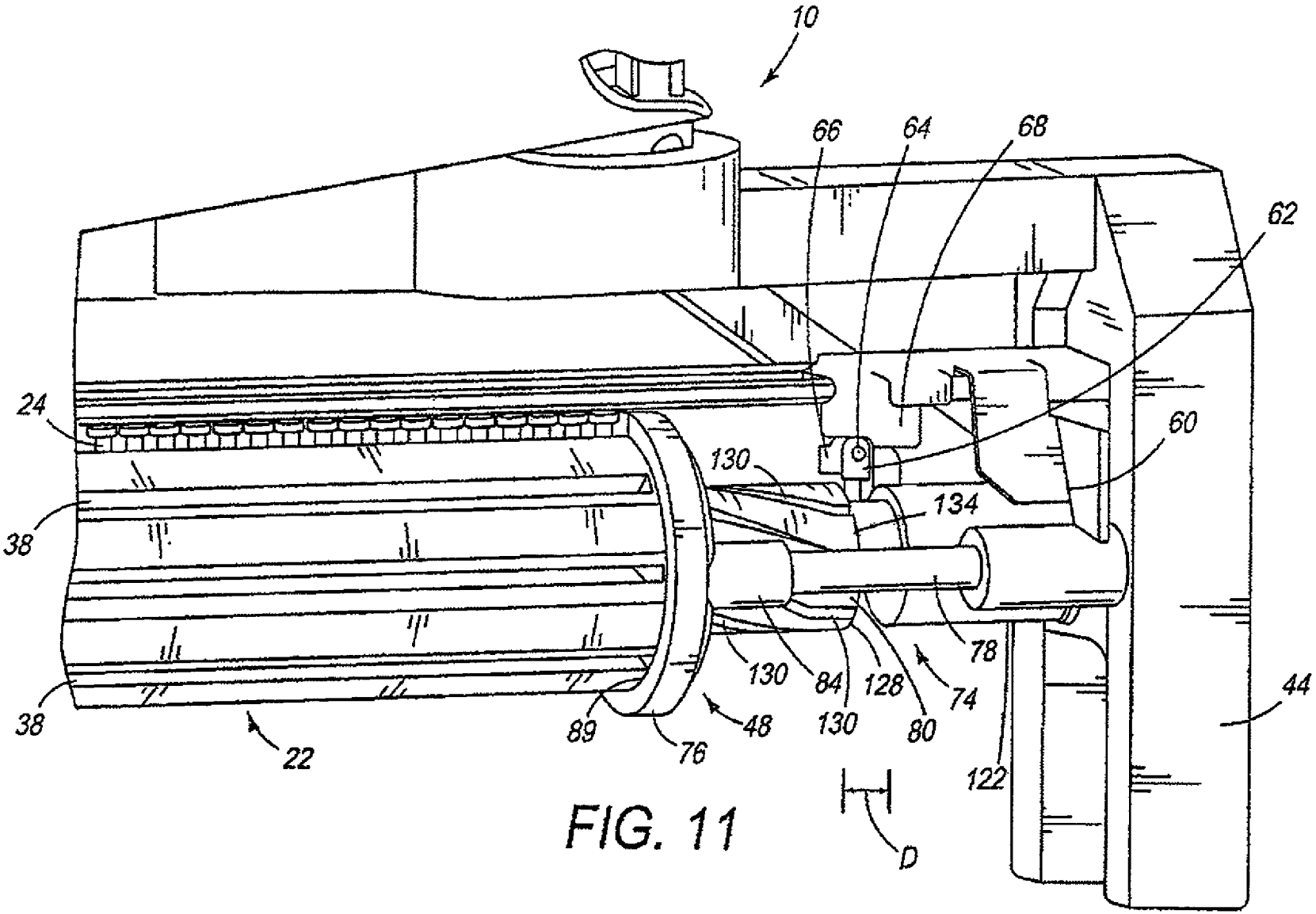
FIG. 11 is an enlarged fragmentary side perspective view of the tool of FIG. 1.

Referring now to FIGS. 1 and 11, depending from the follower 52 is a locating lug 62 which pivots about a pivot point 64 transverse to the follower rail 50. The follower 52 includes a stop formation 66 which prevents pivoting movement of the locating lug 62 past the vertical or magazine rotating position shown in FIG. 1 and towards the nosepiece 20, but allows free pivoting movement of the lug towards the rear bracket 44 in a retractable magazine feed position when the follower is released by the user. It will be understood that a follower tab 68, which directly contacts the fasteners 24 and the locating lug 62, is dimensioned to be freely slidable within the fastener slots 38.

Referring now to FIGS. 1 and 2, the magazine 22 is held in position on the tool 10 between a fixed front plate 70 including a fastener channel 72 in communication with the nosepiece 20, and a biased magazine release 74 including a magazine holder 76, a pair of guide rods 78, a grooved cam 80 and a release handle 82 (FIG. 2). Connecting the magazine holder 76 to the rear bracket 44, the guide rods 78 are slidably received in bores 84 located in the rear bracket. As will be described in further detail below, once the magazine 22 requires exchange, or in the event the operator needs to remove the magazine for maintenance purposes, the user manipulates the release handle 82 by pulling it rearward of the rear bracket 44 (to the right in FIG. 1) which retracts the magazine holder 76, the guide rods 78 and the cam 80 to allow exchange of the magazine 22 once empty with one having a full complement of the fasteners 24.

Referring now to FIGS. 1-5, the magazine 22 includes the magazine housing 40, which is preferably cylindrical in shape, however other shapes are contemplated. The plurality of fastener slots 38 are each elongate, peripherally spaced, and extend radially from a point adjacent an axial bore 86 (FIG. 3) to a narrowed aperture 88 which is dimensioned for preventing radial escape of the fasteners from the magazine. It will be seen from FIG. 3 that the slots 38 are not in communication with the axial bore 86. Also, the slots 38 extend along the longitudinal axis 'L' of the magazine 22. The slots 38 are dimensioned to slidingly accommodate the fasteners 24 and any associated collating material 42. While eight slots 38 are depicted in the preferred embodiment, the number and configuration of the slots may vary to suit the situation or type of fastener used.

Referring now to FIGS. 1, 2, 3, 4, 9 and 12, each slot 38 is open at a first end 89 and a second end 90 of the magazine 22. A cap or rear fastener keeper 92 is provided at the first end 89, which is closest to the rear bracket 44. The cap 92 is generally star-shaped, and is rotatable relative to a central plug 94 engaging the axial bore 86, such as by a press fit. Once installed, the cap 92 prevents escape of the fasteners 24 from the first end 89.

Referring now to FIGS. 4-7, 8*a* and 9, opposite the cap 92, a front fastener keeper 98 is provided at the second end 90. The front fastener keeper 98 is identical to the cap 92 and is also star-shaped; having a plurality of radially projecting arms 100 each associated with one of the fastener slots 38. The arms 100 each have a locking lug or protrusion 101 projecting transversely from an end of the arm. In addition, the arms 100 radiate from a hub 102 which is engageable in the axial bore 86 and is rotatable relative to the magazine housing 40 between a closed position (FIG. 4) in which fasteners 24 cannot escape from the second end 90, and an open position (FIGS. 5 and 6) which is employed when the magazine 22 is in operation in the tool 10. In the open position, the locking lugs 101 engage openings 103 in the magazine housing 40. In the closed position, the lugs 101 engage the fastener slog 38. While the dimensions may vary to suit the application, there is a preferred 1/16 turn between the open and closed positions described above. It is preferred that the fastener keeper 98 is maintained in the closed position until moved by the user once it is placed in the tool 10 as described below.

Figure 7:
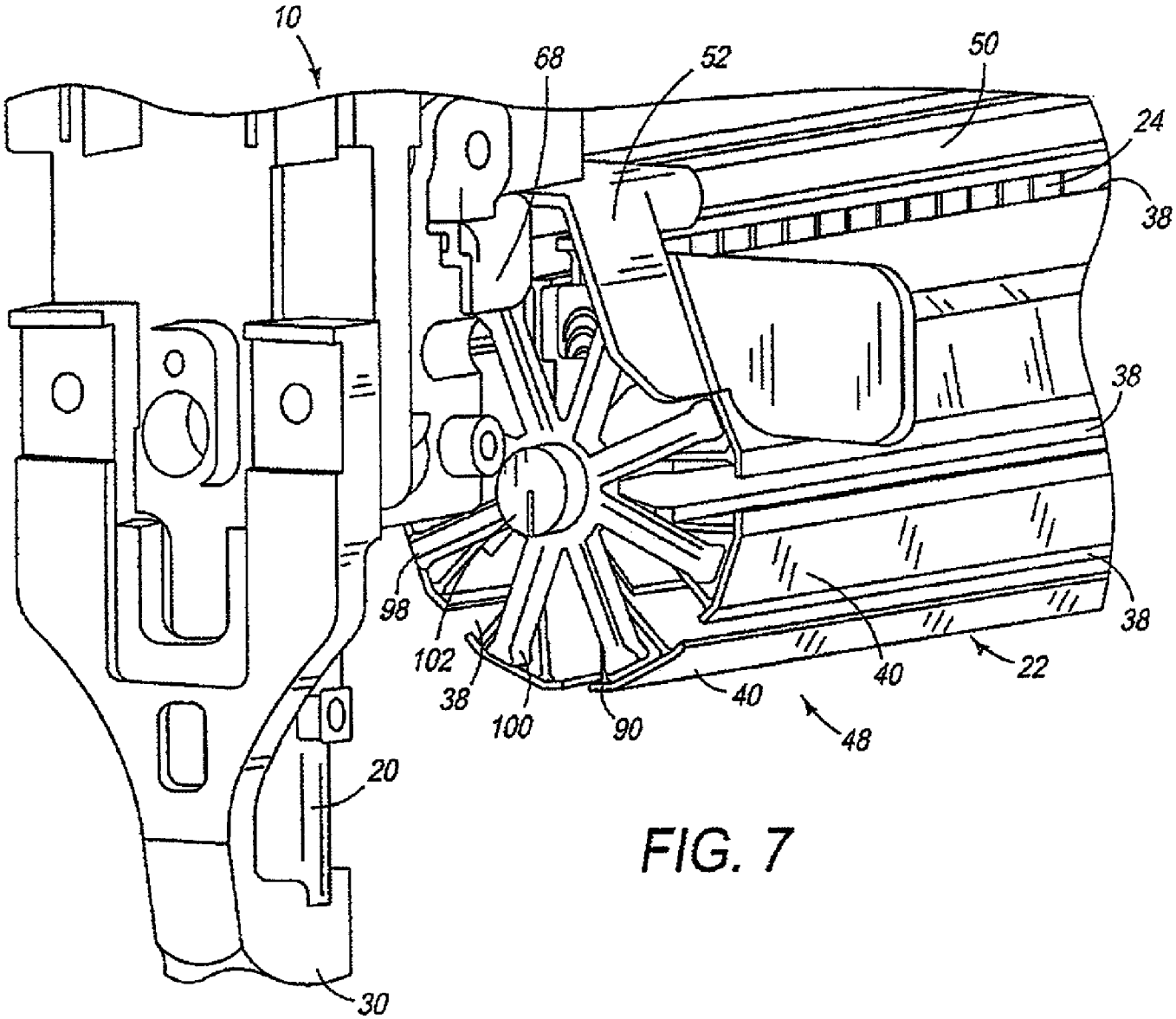
FIG. 7 is a fragmentary front perspective of the tool of FIG. 1 with portions removed for clarity.

Note that the bore 86 is noncircular (FIG. 3) and it is preferred that the fastener keepers 92, 98 are configured so that the central plug 94 has a complementary shape for engaging the bore 86 via a press fit for rotation in only one direction when viewed from the front of the tool (on the left in FIG. 1). In the preferred embodiment, the rotation is clockwise-only (monodirectional), however applications are contemplated in which only counter-clockwise movement is warranted. As seen in FIGS. 1 and 7, the hub 102 also extends toward the nosepiece 20 and engages an aperture 104 in the front plate 70.

Figure 8:
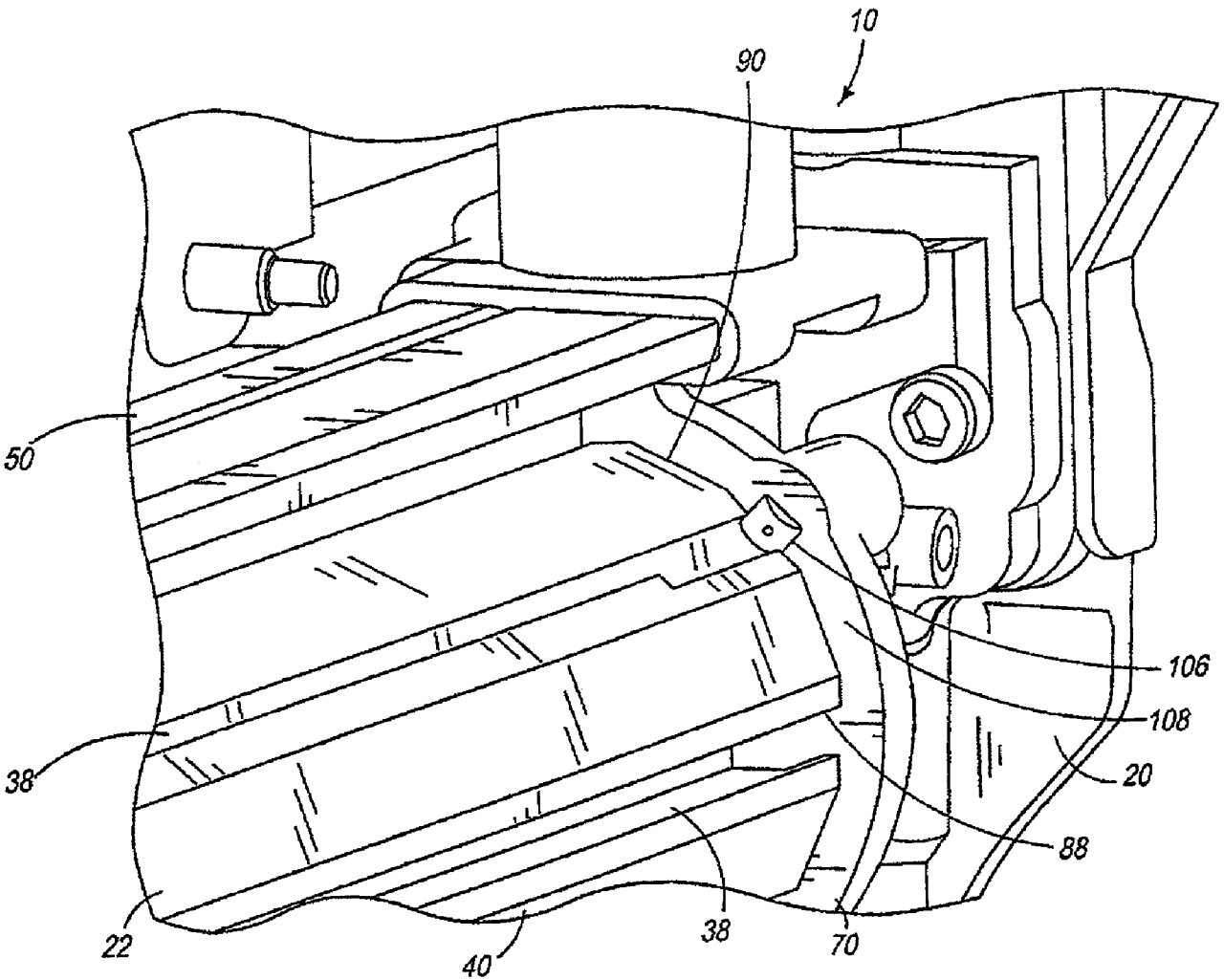
FIG. 8 is an enlarged fragmentary rear perspective of the tool of FIG. 2.
Figure 8A:
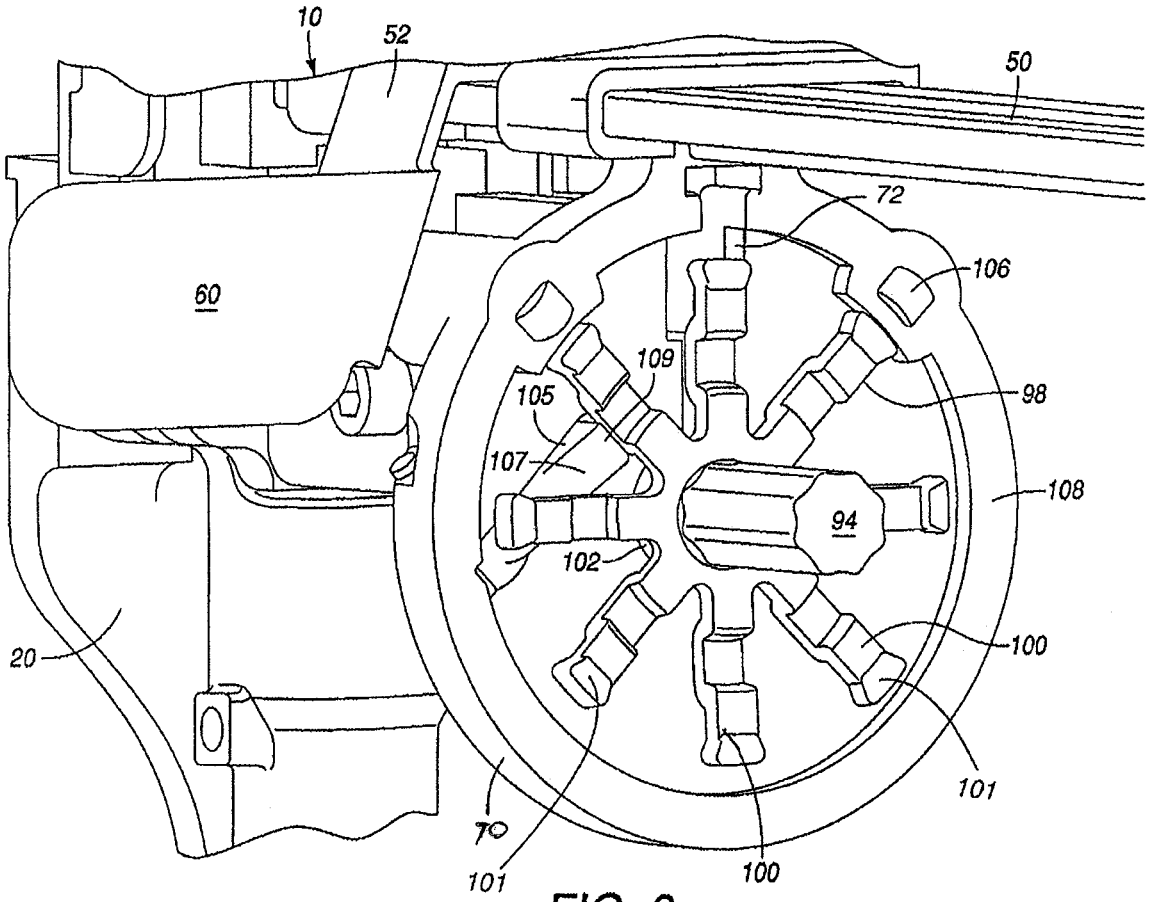
FIG. 8*a* is a fragmentary rear view of the tool as seen in FIG. 8.

Referring now to FIGS. 8 and 8*a*, it will be seen that the magazine 22 is rotatable relative to the front plate 70 at the second end 90 and the magazine holder 76 at the first end 89. Once a fastener slot 38 is selected for operational engagement with the nosepiece 20, it is desirable to prevent further magazine rotation until the fasteners 24 in the slot have been consumed. Accordingly at least one and preferably two releasable locks 106 are provided to the front plate 70 in the form of a spring-loaded ball or other projection which extends from a rear surface 108 of the front plate and engages an unused fastener slot 38. The location of the locks 106 may vary, but in the preferred embodiment, they are positioned for engaging the slots 38 on either side of the slot presently in engagement with the nosepiece 20. It will be understood that the locks 106 are sufficiently biased to restrain the magazine 22 in position, but the biasing force can be overcome upon tool-generated rotation of the magazine.

To facilitate movement of the keeper 98 between the open and closed positions, the front plate 70; and the holder 76 are preferably provided with a ramp lock 105 which projects through an opening in the front plate and is biased by a spring (not shown) away from the nosepiece 20 and towards the rear bracket 44. The ramp lock 105 has a ramped surface 107 which sequentially receives the radially projecting arms 100 of the fastener keeper 98 as they rotate towards the aperture 104. As the magazine 22 rotates, which occurs when one fastener slot 38 is emptied and the next adjacent slot is engaged, each arm 100 engages and presses against the lock 105 at a ramp portion 107 to sufficiently retract the lock, overcoming the biasing force to allow movement of the arm 100 and rotation towards the aperture 104.

Figure 12:
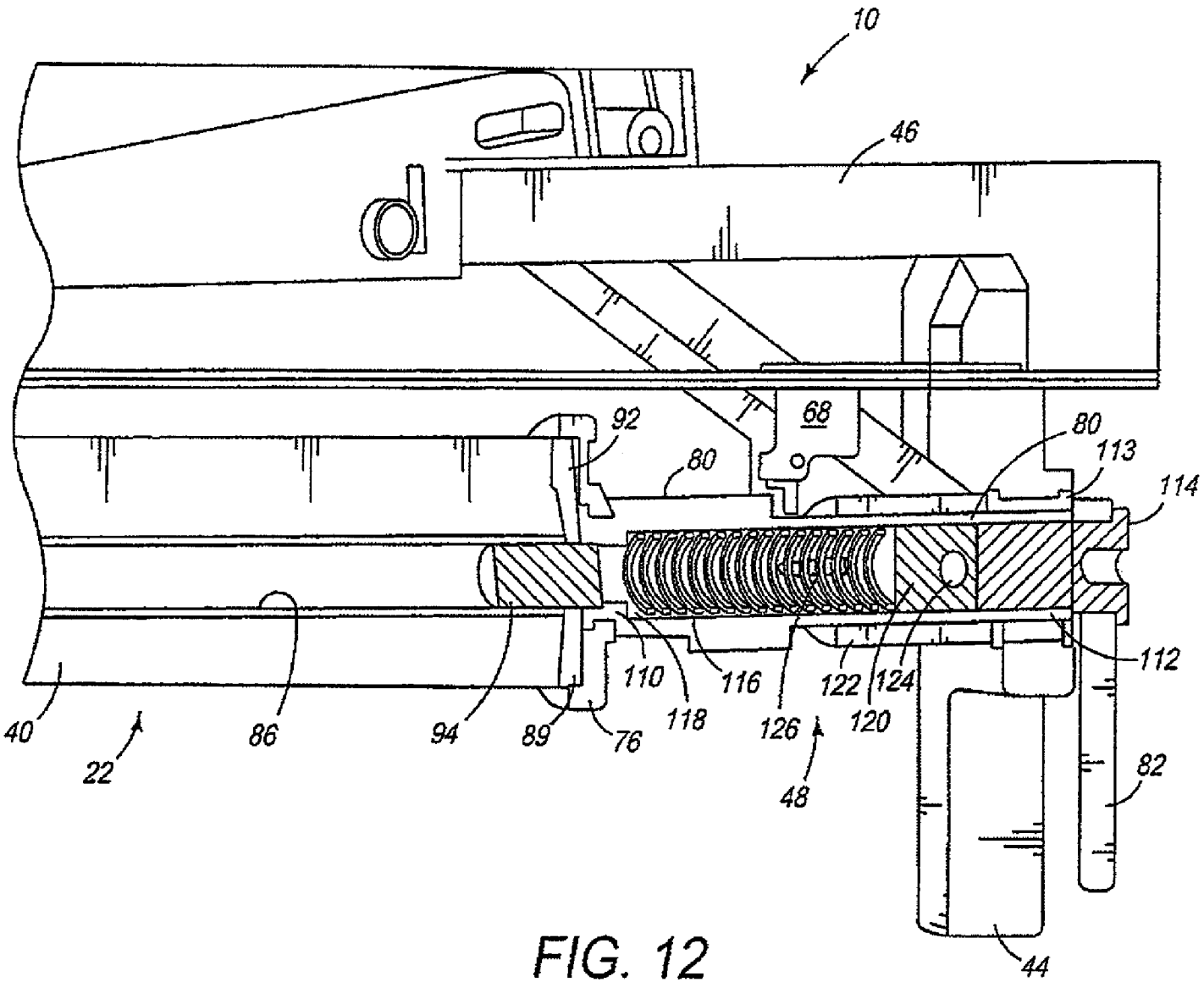
FIG. 12 is a fragmentary vertical section of the tool shown in FIG. 11.

Referring now to FIGS. 4, 5, 8*a* and 12, the lock 105 is also employed as the user first installs the magazine 22 into the tool, and facilitates movement of the keeper 98 from the closed to the open position. In operation, the magazine 22 is replaced with the follower 52 in the retracted position (FIG. 12). As seen in the preferred embodiment, there are eight arms 100 on the keeper 98, but sixteen potential positions including the fastener slots 38 and the openings 103. As described above, the lock 105 permits counter-clockwise rotation of the magazine (including the keeper) in 1/8 turn increments as viewed from the front of the tool 10. However, the magazine housing 40 is rotatable by the user a 1/16 turn backwards relative to the keepers 98 (clockwise relative to the front of the tool as seen in FIG. 1, counterclockwise as seen in FIG. 8*a*), which disengages the locking lugs 101 from the closed position (FIG. 4) in the fastener slots 38 and moves them to the openings 103 to achieve the open position of FIG. 5. Once the lugs 101 are seated in the openings 103, there is a tactile and/or audible indication to the user.

To realign the fastener slot 38 with the fastener channel 72, the user then rotates the magazine 22 in the opposite direction 1/16 of a turn. In this latter movement, the magazine body 40 and the keepers 98 move together. The user is alerted to the magazine 22 being in the proper position by the engagement of the spring biased locks 106 in the corresponding fastener slots 38 on each side of the fastener channel 72, which is tactile and/or audible to the user. The user can also see the fastener slot 38 aligned with the fastener channel 72 by watching the area close to the retracted follower 52.

After the arm 100 clears the ramped surface 107, the spring presses the lock 105 to its original position. The fastener keeper 98 is prevented against backward rotation by a stop 109 on the lock 105, which projects toward the rear bracket 44. It will be appreciated that the ramp lock 105 emits a tactile as well as an audible indication of the indexing of the magazine 22. While only the lock at the front plate 70 has been described, it will be appreciated that a similar structure is optionally provided at the holder 76.

As each slot 38 is emptied of fasteners, the user pulls back the follower 52 toward the rear bracket 44. As the follower approaches the grooved cam 80, the locating lug 62 engages the uppermost groove as described below. Further retraction of the follower 52 causes the lug 62 to travel in the groove, thus rotating the cam 80 and rotating the magazine 22 so that the next slot 38 becomes aligned with the aperture 104 in the front plate 70.

Installation/replacement of the magazine 22 is accomplished by first pulling back on the follower 52 and locking it against the rear bracket 44 as seen at the rear of FIG. 1. Next, the user pulls on the release handle 82 a sufficient distance to create a clearance for the magazine 22 from the nosepiece 20. The magazine 22 is installed/replaced, and the release handle 82 is released. Next, the holder 76 is urged back to the operational position, where the hub 102 on the fastener keeper 98 is rotatably centered on the front plate 70, and the central plug 94 on the cap 92 (FIG. 12) is rotatably secured to the holder 76.

Figure 13:
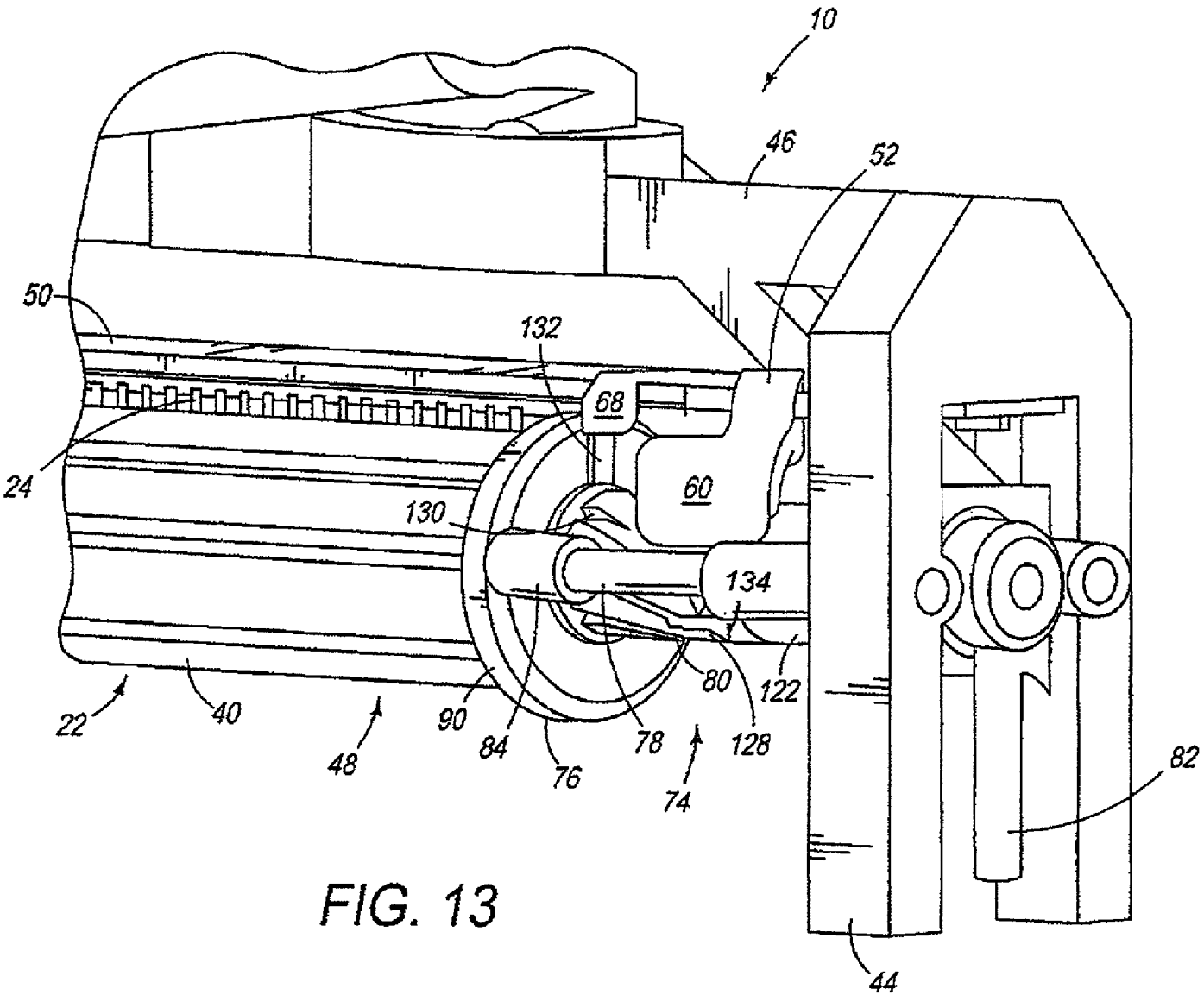
FIG. 13 is a fragmentary rear perspective of the tool shown in FIG. 12.
Figure 14:
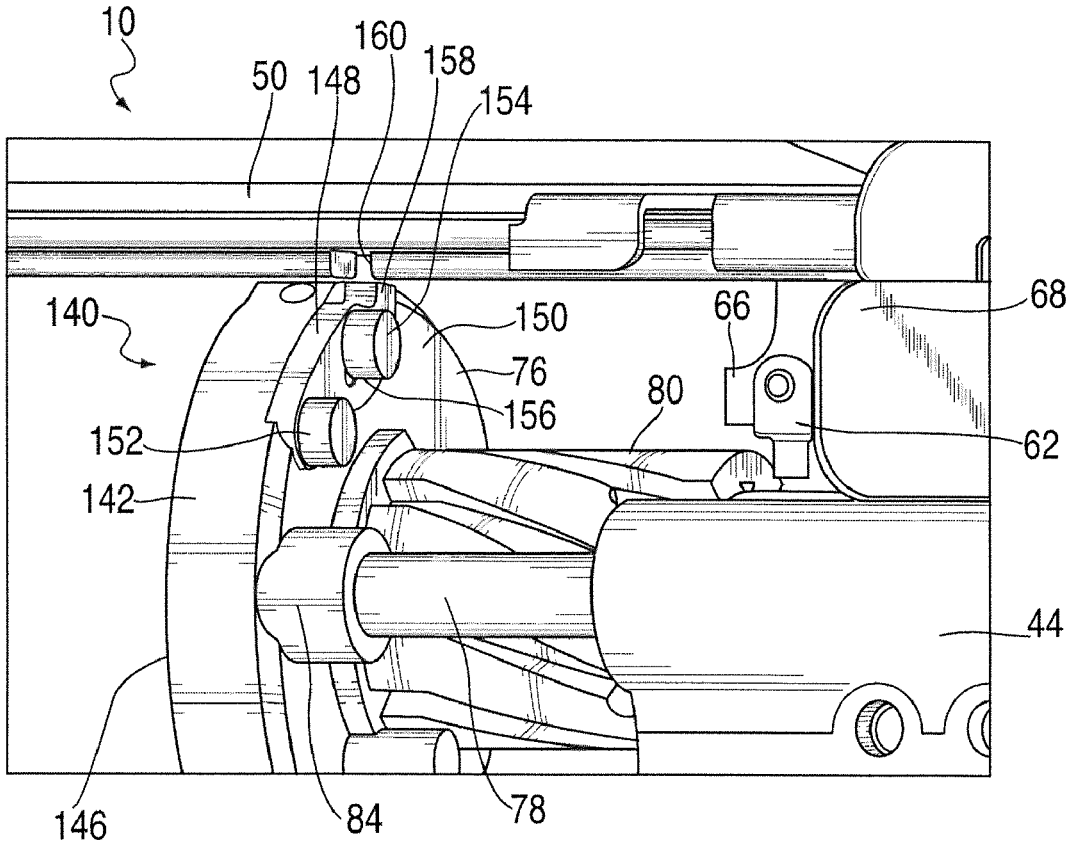
FIG. 14 is a fragmentary top perspective of an embodiment of the present tool provided with a magazine latch shown in the home or unlocked position.

Referring now to FIGS. 11-13, the magazine release 74 and the rotation of the magazine 22 will be described in greater detail. The magazine holder 76 is connected to an end 110 of the grooved cam 80, which engages the plug 94. Thus, the cam 80, the plug 94 and the magazine housing 40 all rotate together. While axially slidable, the holder 76 is nonrotatable due to the presence of the guide rods 78. At an opposite end 112, the cam 80 is secured to the rear bracket 44 by a bushing 113. A bolt 114 secures the release handle 82 to the opposite end 112 of the cam 80 for common rotation and axial movement. A return spring 116 is disposed in a central bore 118 and biases the magazine holder 76 away from a pusher 120 fixed to a cam bushing 122 by a pin or fastener 124. The cam 80 has a slot 126 for accommodating the pin 122, and as such the axial movement of the cam 80 is relative to the cam bushing 122.

Figure 10:
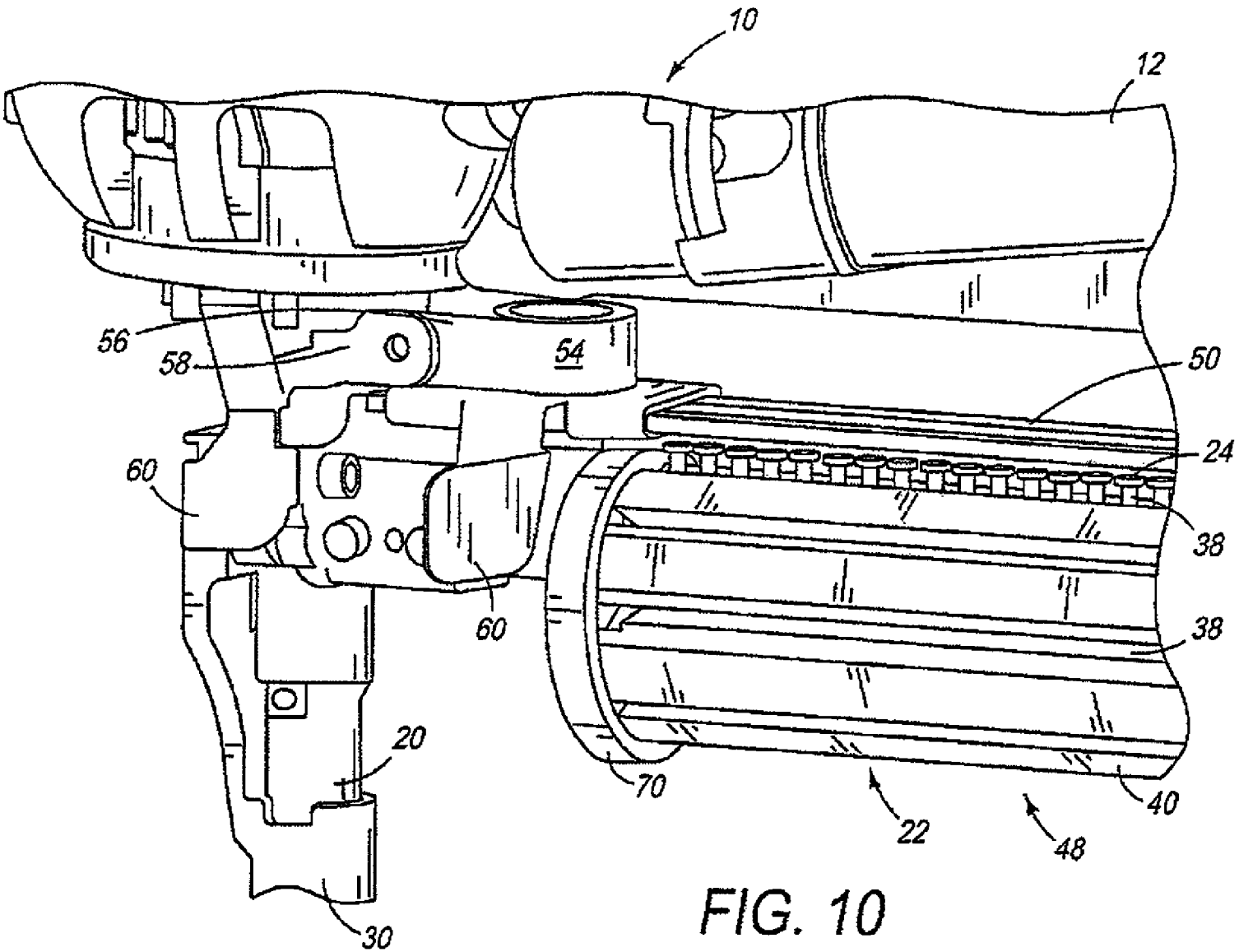
FIG. 10 is an enlarged fragmentary side perspective view of the tool of FIG. 1.

As described above, an exterior surface 128 of the cam 80 is provided with a plurality of helical grooves 130. Once the operational fastener slot 38 is empty or is almost empty of the fasteners 24, the follower 52 is near or contacting the nosepiece 20. It is often desirable for the bracket 72 to have a few fasteners 24 remaining when the user is notified to use the next (loaded) slot (FIG. 10). The user grasps the follower handle 60 and pulls the follower 52 back towards the rear bracket 44 against the force of the negator spring 54.

During this motion, the follower tab 68 and the locating lug 62 travel in the slot 38. As the follower 52 approaches the magazine holder 76, the follower tab 68 and the lug 62 pass through a gap 132 in the magazine holder. The locating lug 62, which when moving toward the rear bracket 44 is locked in a depending position by the stop formation 66, engages one of the grooves 130 and, due to the helical configuration of the grooves, the linear rearward motion of the follower 52 causes the magazine housing 40 and the cam 80 to rotate sufficiently to place the next slot 38 in registry with the gap 132 and to be in operational position with the nosepiece 20 to deliver fasteners. Thus, the configuration of the grooves 130 is coordinated with the number and peripheral spacing of the fastener slots 38.

Next, the user releases the follower handle 60, the negator spring 54 pulls the follower tab 68 towards the nosepiece 20 and into position against the fasteners, and the locating lug 62 now freely pivots rearwardly and does not hinder the action of the follower tab. The tool 10 is now in position to utilize the next, full fastener slot 38. This operation is repeated until all of the slots 38 are emptied or substantially emptied of the fasteners 24.

Once the magazine is empty or substantially empty, the user pulls the follower 52 and latches it on the rear bracket 44. Next, the user pulls on the release handle 82 against the force of the return spring 116. The amount of rearward travel of the handle 82 and the cam 80 is determined by a distance 'D' (FIG. 11) between the bushing 122 and an end 134 of the grooves 130. This distance 'D' is sufficient to retract the magazine holder 76, which is supported in this movement by the guide rods 78, and to allow the user to pull the magazine 22 out of engagement with the front plate 70. Thus, the magazine holder 76 is movable on the guide mechanism defined by the guide rods 78 between a biased position in which the holder engages the magazine 22, and a retracted position achieved upon the user pulling the release handle 82. The user can then disengage the magazine 22 and replace it with another full magazine.

Referring now to FIGS. 14-18, it is preferred that the present tool 10 is provided with a magazine latch, generally designated 140, shown mounted in the magazine holder 76, however other locations on the tool are contemplated. The latch 140 pivots relative to an upper peripheral edge 142 of the magazine holder 76 and has a first portion 144 associated with a front surface 146 of the holder, and a second portion 148 associated with a rear surface 150 of the holder. It will be seen that the second portion 148 is generally arcuately shaped to conform to the periphery of the magazine holder 76.

A pair of bosses 152, 154 secure the latch 140 in place on the magazine holder 76, with the boss 152 acting as a pivot point or axis, and the boss 154 acting as a retainer. Accordingly, the second portion 148 has a slot 156 dimensioned for accommodating the range of pivot motion of the latch 140 between the home or unlocked position (FIGS. 14 and 15) and the advanced or locked position (FIGS. 16 and 17). The latch 140 pivots in the general plane defined by the magazine holder 76. Opposite the boss 152, the latch 140 has an upturned lug 158 configured for engaging a notch 160 in a lower surface of the follower rail 50 (best seen in FIG. 17).

Referring now to the front surface 146 of the magazine holder 76, the first portion 144 is also slightly arcuate, but arches convexly toward the central plug 94 in an opposite direction from the shape of the second portion 148 and is constructed and arranged for engaging ends of the radial arms 100 of the fastener keeper 92 associated with the rear or first magazine end 89 of the magazine 22.

Figure 18:
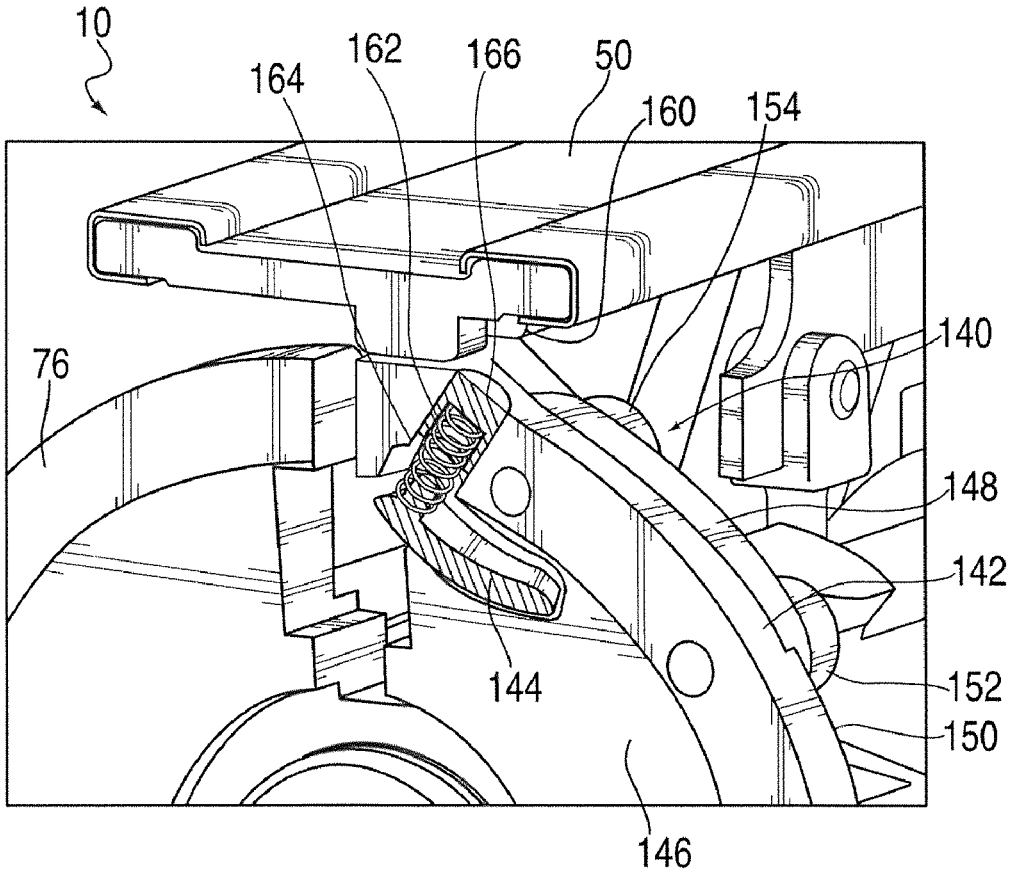
FIG. 18 is an enlarged fragmentary front perspective of the tool seen in FIG. 15 showing the latch in greater detail.

Referring now to FIG. 18, a biasing element 162, preferably a coiled spring, is positioned in an angled bore 164 of the fastener keeper 76 and held in place by a plug-like spring holder 166. The biasing element 162 biases the latch 140 about the pivot boss 152 towards a home or unlocked position (FIGS. 14 and 15) in which the upturned lug 158 is disengaged from the notch 160, permitting axial movement of the holder 76 relative to the support frame 46. Such movement is helpful in removing and replacing magazines 22 from the tool 10.

Figure 15:
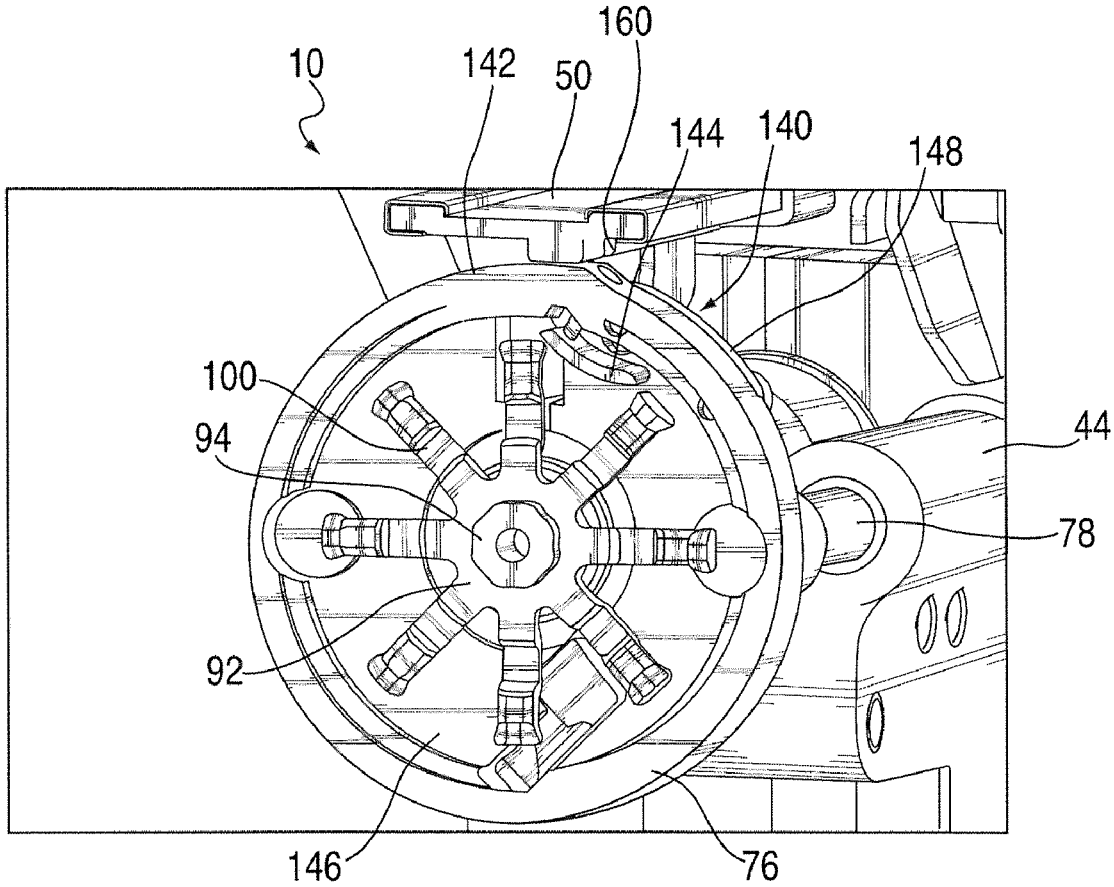
FIG. 15 is a fragmentary front perspective of the tool seen in FIG. 14.
Figure 16:
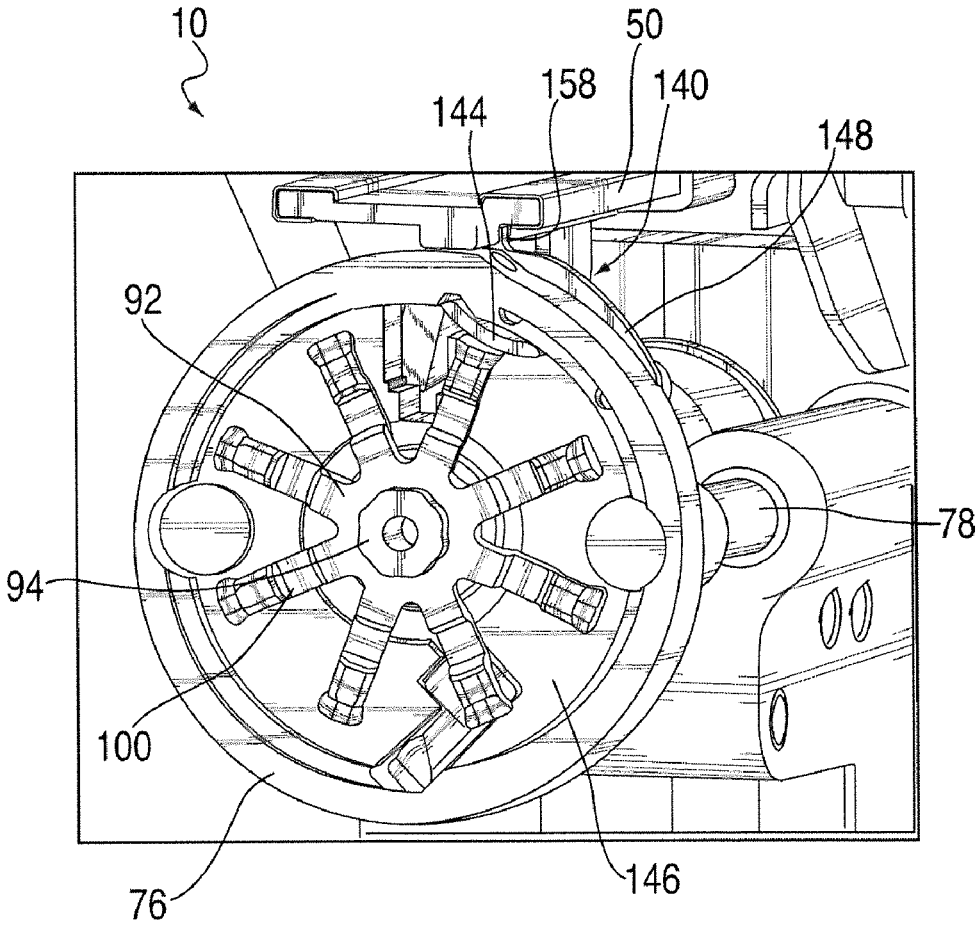
FIG. 16 is a fragmentary front perspective of the tool shown in FIG. 15 in the advanced or locked position.
Figure 17:
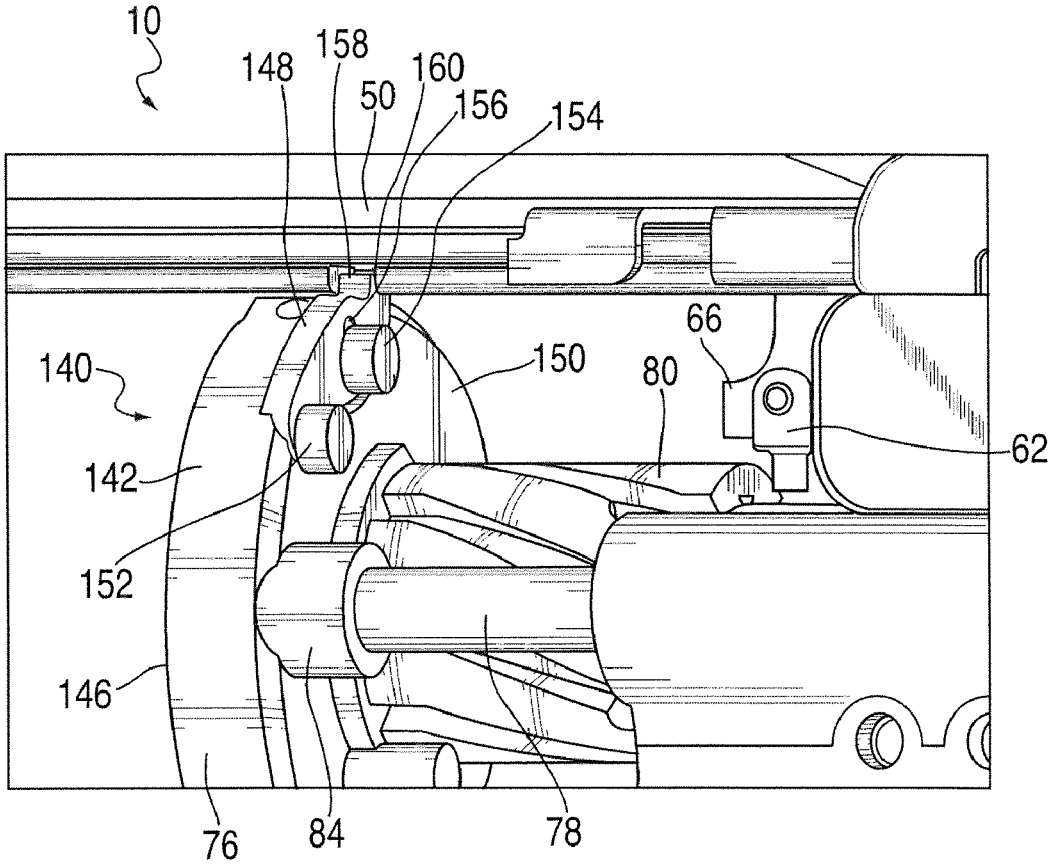
FIG. 17 is a fragmentary top perspective of the embodiment shown in FIG. 14 shown in the advanced or locked position.

Referring now to FIGS. 15 and 16, the first portion 144 is configured and disposed relative to the magazine holder 76 to prevent movement of the fastener keeper 92 in a way that permits unwanted release of the fasteners upon removal of the magazine 22 from the tool 10. Such a release is possible if the magazine 22 is removed from the tool 10 or otherwise handled by the user while the fastener keeper 92 is in the open position (best seen in FIG. 5), in which the fasteners 24 can readily slide out of the fastener slots 38.

In the home position of FIG. 15, the fastener keeper 92 is in the closed position, preventing escape of the fasteners, and also preventing fastener delivery to the tool 10. In this position, the first portion 144 is not engaging the arms 100 and the upturned lug 158 is retracted from the notch 160. To position the magazine 22 so that the fasteners 24 are delivered to the fastener passageway 26, the user rotates the magazine axially 1/16 of a turn backwards, causing the arm 100 to engage the convex first portion 144 in a way that pushes against the latch 140, causing pivoting movement and overcomes the biasing force of the biasing element 162. This same operation causes the upturned lug 158 to engage the notch 160. Thus, the tool 10 is now in the operational position for fastener delivery to the fastener passageway 26. Also, the magazine holder 76 is held axially in place to resist operational G-forces in this direction resulting from combustion events. With the holder 76 held in place, the magazine 22 is also secured.

Once the user desires to remove the magazine 22, as described above the magazine is rotated 1/16 of a turn in the forward direction to replace the arms 100 in the closed position and to engage the locking lugs 101. Thus, the latch 140 ensures that the fastener keeper arms 100 are in the closed position before the magazine 22 is removed from the tool 10. This movement also releases pressure on the latch 140, causing the sprint 162 to disengage the lug 158 from the notch 160, permitting retraction of the magazine holder 76 and removal of the magazine 22.

While a particular embodiment of the present rotary magazine has been shown and described, it will be appreciated by those skilled in the art that changes and modifications may be made thereto without departing from the invention in its broader aspects and as set forth in the following claims.

What is claimed is:

1. A fastener driving tool, comprising:

a housing substantially enclosing a power source including a reciprocating piston with a driver blade;

a nosepiece associated with said housing and configured for receiving said driver blade and for sequentially receiving fasteners for engagement with said driver blade for driving into a workpiece;

a magazine configured for retaining a supply of the fasteners and for sequentially feeding the fasteners to said nosepiece, said magazine storing a plurality of elongate strips of the fasteners, and being configured for rotating about a longitudinal axis of said magazine for providing access of fasteners in each fastener strip to said nosepiece;

said magazine has a housing being generally cylindrical in shape and has a plurality of elongate, peripherally spaced, radial slots extending along said longitudinal axis of said magazine; and each said slot is open at first and second ends of said magazine, a fastener keeper is attached at each of said first end and said second end, said keepers being removable with said magazine from said tool and being rotatable relative to said magazine housing between a closed position and an open position for retaining fasteners in said slots when said magazine is removed from the tool.

2. The tool of claim 1 further including a latch on said tool configured for engaging said fastener keeper so that said closed position is maintained when said magazine is being removed from said tool and also locks said magazine in position during tool operation when said fastener keeper is in said open position.

3. The tool of claim 2 wherein said latch secures said magazine against axial shock forces.

4. The tool of claim 1 further including a magazine support frame associated with said housing and configured for supporting a first end of said magazine.

5. The tool of claim 4 wherein said support frame supports a portion configured for exerting a releasable biasing force on said magazine which urges said magazine toward said nosepiece.

6. The tool of claim 5 further including a user-actuated magazine release configured for overcoming said biasing force and retracting a magazine retainer to permit magazine exchange.

7. The tool of claim 6 wherein said magazine release is provided with a guide mechanism for maintaining alignment of a magazine holder between a biased position and a retracted position.

8. The tool of claim 4 wherein said support frame is configured for rotating said magazine about said axis to enable sequential access of the fastener strips to said nosepiece.

9. The tool of claim 4 further including at least one releasable lock for retaining said magazine in a selected position.

10. The tool of claim 1 wherein said tool is provided with a magazine follower for urging fasteners in a selected slot towards said nosepiece, said tool being configured so that retraction of said follower by the user causes rotation of said magazine so that said selected slot is rotated out of an operational position, and a next said slot is indexed into said operational position.

11. The tool of claim 10 wherein said follower is provided with a locating lug which is rotatable between a depending magazine rotating position when said follower is retracted, and a retractable magazine feed position when said follower is released.

12. The tool of claim 11 further including a magazine support with a cam having a plurality of spiral grooves configured for accommodating said locating lug and dimensioned to correspond to said magazine slots so that a designated one of said magazine slots is rotated to said operational position upon each retraction of said magazine follower.

13. A fastener driving tool, comprising:

a housing substantially enclosing a power source including a reciprocating piston with a driver blade;

a nosepiece associated with said housing and configured for receiving said driver blade and for sequentially receiving fasteners for engagement with said driver blade for driving into a workpiece;

a magazine configured for retaining a supply of the fasteners and for sequentially feeding the fasteners to said nosepiece, said magazine storing a plurality of elongate strips of the fasteners, and being configured for rotating about a longitudinal axis of said magazine for providing access of fasteners in each fastener strip to said nosepiece; and a biased magazine follower configured for urging fasteners toward said nosepiece, and said tool is configured such that upon retraction of said follower, said magazine is rotated about said axis to from a position where an empty slot is aligned with said nosepiece to provide access of a second fastener strip to said nosepiece.

14. A magazine for a fastener driving tool, comprising: a magazine housing having a plurality of peripherally spaced, radial slots extending along a longitudinal axis of said housing, each said slot configured for accommodating a plurality of linearly arranged fasteners; and an axial bore upon which said housing is rotatable for providing selected sequential access to said slots; and a fastener keeper attached at least one said end of said housing and being rotatable relative to said housing between a closed position and an open position.

15. The magazine of claim 14 wherein said fastener keeper has a plurality of radially extending fingers constructed and arranged to correspond to respective ones of said plurality of fastener slots, each said finger having a locking lug selectively engageable in an associated one of said fastener slots or in an opening in said magazine housing.

16. The magazine of claim 15 wherein said magazine is rotatable in a first direction in normal operation, and is also rotatable a specified distance in an opposite direction to said first direction for moving said fingers from said fastener slots to said opening to move said fastener keeper from said closed position to said open position.

17. The magazine of claim 14 wherein each said fastener keeper is provided with a plug engaged in said axial bore.

* * * * *